US007095017B2

(12) United States Patent
Hofstadler et al.

(10) Patent No.: US 7,095,017 B2
(45) Date of Patent: Aug. 22, 2006

(54) SYSTEMS AND METHOD OF A GATED ELECTROSPRAY INTERFACE WITH VARIABLE FLOW RATE FOR HIGH THROUGHPUT MASS SPECTROMETRIC ANALYSIS

(75) Inventors: Steven A. Hofstadler, Oceanside, CA (US); Jared J. Drader, Encinitas, CA (US); Kristin A. Sannes-Lowery, Vista, CA (US); Richard H. Griffey, Vista, CA (US)

(73) Assignee: Isis Pharmaceutical, Inc., Carlsbad, CA (US)

( * ) Notice: Subject to any disclaimer, the term of this patent is extended or adjusted under 35 U.S.C. 154(b) by 0 days.

(21) Appl. No.: 10/939,753

(22) Filed: Sep. 13, 2004

(65) Prior Publication Data

US 2005/0029447 A1 Feb. 10, 2005

Related U.S. Application Data

(63) Continuation of application No. 10/163,434, filed on Jun. 4, 2002, now abandoned.

(60) Provisional application No. 60/295,588, filed on Jun. 4, 2001.

(51) Int. Cl.
*H01J 49/00* (2006.01)

(52) U.S. Cl. ..... 250/288

(58) Field of Classification Search ..... 250/288
See application file for complete search history.

(56) References Cited

U.S. PATENT DOCUMENTS 4,935,624 A * 6/1990 Henion et al. ..... 250/288
5,415,841 A * 5/1995 Dovichi et al. ..... 422/68.1
6,040,575 A 3/2000 Whitehouse et al.
6,207,954 B1 3/2001 Andrien, Jr. et al.
6,541,767 B1 4/2003 Kato
6,576,896 B1 6/2003 Figeys et al.
6,586,731 B1 * 7/2003 Jolliffe ..... 250/288
6,641,783 B1 11/2003 Pidgeon et al.
2002/0134718 A1 9/2002 Hindsgaul et al.

* cited by examiner

*Primary Examiner*—Nikita Wells
*Assistant Examiner*—Phillip A. Johnston
(74) *Attorney, Agent, or Firm*—Wilmer Cutler Pickering Hale and Dorr LLP

(57) ABSTRACT

The present disclosure is related to improved systems and methods for delivering samples for high-throughput mass spectrometric analysis to an atmospheric-pressure ionization source. In an exemplary embodiment, the system includes a solvent reservoir for storing a solvent solution, a first valve which is coupled to the solvent reservoir, first and second pumps for delivering solvent solution and which are coupled to the first valve and which the delivery flow rate of the first pump is greater than the delivery flow rate of the second pump, an injection system having a sample injector and an second valve which is coupled to the first valve and which is capable of being coupled to can be couple to an electrospray ionization source. In another embodiment, the system can also include an atmospheric-pressure ionization chamber, an atmospheric-pressure ionization sprayer and a nebulizer gas source and a voltage supply source. In yet another embodiment, the system may further include a puffer valve that is coupled to the nebulizer gas source and the atmospheric-pressure ionization sprayer and a gas puffer that is coupled to the puffer valve. A distal end of the gas puffer may be located within the atmospheric-pressure ionization chamber and aligned with the distal end of the atmospheric-pressure ionization sprayer and the puffer valve may control the delivery of the nebulizer gas to the atmospheric-pressure ionization sprayer and the gas puffer.

35 Claims, 7 Drawing Sheets

ESI Sprayer
Puffer 42
44
420
440
450
62
460
241
High Flow Rinse and Sample Injection
205
Puffer Droplet Removal
Puffer Valve position 1
207
Energize ESI
Puffer Valve position 2

Puffer Valve

Position 1 Figure 6a

Position 2 Figure 6b

Position 3 Figure 6c

SYSTEMS AND METHOD OF A GATED ELECTROSPRAY INTERFACE WITH VARIABLE FLOW RATE FOR HIGH THROUGHPUT MASS SPECTROMETRIC ANALYSIS

REFERENCE TO RELATED U.S. APPLICATIONS

This application claims priority to U.S. Provisional Patent Application No. 60/295,588 filed Jun. 4, 2001, the entire contents of which are herein incorporated by reference.

BACKGROUND OF THE INVENTION

The present invention relates to systems and methods for delivering samples for mass spectrometric analysis. More specifically, the present invention relates to systems and methods for facilitating high throughput mass spectrometric analysis of generated electrospray ionized samples.

Generating electrospray ionized samples for mass spectrometric analysis generally requires samples to be delivered to electrospray ionization source at a low flow rate. To minimize contamination and improve the accuracy of the results of the mass spectrometric analysis, before another sample can be processed by a delivery system which delivers the samples to the electrospray ionization source, those portions of the delivery system which were exposed to the previous sample need to be thoroughly rinsed. Existing sample delivery systems accomplish this rinse cycle at the same flow rate at which the samples are delivered to the electrospray ionization source. Because the volume of rinsing agent that may be required to adequately rinse the delivery system can be quite large, existing delivery systems cannot support high throughput mass spectrometric analysis protocols since a significant amount of time for rinsing has to be expended between the introduction and analysis of each subsequent sample.

SUMMARY OF THE INVENTION

The present disclosure is directed at improved systems and methods for delivering samples for high-throughput mass spectrometric analysis to an atmospheric-pressure ionization source. In an exemplary embodiment in accordance with present disclosure, the system has a solvent reservoir for storing a solvent solution, a first valve which is coupled to the solvent reservoir, first and second pumps for delivering solvent solution and which are coupled to the first valve, an injection system having a sample injector and an second valve which is coupled to the first valve and which is capable of being coupled to an electrospray ionization source. In an exemplary embodiment, the delivery flow rate of the first pump is greater than the delivery flow rate of the second pump and, additionally, the injection system, which is coupled to the second valve, can deliver a sample to the second valve. The system can also include a controller to control the operations of the first valve, the first pump, the second pump, the second valve and the injection system.

In a preferred embodiment, the first and second pumps are highly accurate programmable syringe pumps and the second valve and the first valve are two position, multi-port fluid processors.

In another exemplary embodiment in accordance with the present disclosure, the system may further include an atmospheric-pressure ionization chamber, an atmospheric-pressure ionization sprayer coupled to the second valve, a nebulizer gas source having a nebulizer gas, which is in fluid communication with the atmospheric-pressure ionization sprayer, and a voltage supply source coupled to the atmospheric-pressure ionization sprayer. A distal end of the atmospheric-pressure ionization sprayer can be located within the atmospheric-pressure ionization chamber. The system may similarly have a controller to control the operations of the atmospheric-pressure ionization sprayer, the nebulizer gas source and the voltage supply source. The system may further include a transfer line connected to the second valve and the atmospheric-pressure ionization sprayer. In such an embodiment, the injection system may deliver a sample to the transfer line via the second valve.

In one exemplary embodiment, a delivery flow rate of the injection system is greater than the delivery flow rate of the second pump.

In one preferred embodiment, the system further includes a puffer valve that is coupled to the nebulizer gas source and the atmospheric-pressure ionization sprayer and a gas puffer that is coupled to the puffer valve. A distal end of the gas puffer may be located within the atmospheric-pressure ionization chamber and aligned with the distal end of the atmospheric-pressure ionization sprayer and the puffer valve may control the delivery of the nebulizer gas to the atmospheric-pressure ionization sprayer and the gas puffer.

In an exemplary embodiment in accordance with present disclosure, a method for facilitating high throughput mass spectrometric analysis of generated ionized samples can include the steps of (A) delivering a sample to a transfer line which can be coupled to an ionization sprayer of an atmospheric-pressure ionization source; (B) initiating a low flow delivery of a liquid to the transfer line containing the sample, wherein the low flow delivery of the liquid to the transfer line can cause the sample to be delivered to the atmospheric-pressure ionization source; (C) terminating the low flow delivery of the liquid to the transfer line; (D) rinsing the transfer line by directing a high flow delivery of a liquid to the transfer line, wherein the high flow delivery of the liquid is greater than the low flow delivery of the liquid; and then repeating steps A through D for the next sample to analyzed.

In an exemplary embodiment, the delivering of the sample to the transfer line is controlled by an injector system which rinses the sample injector and prepares the next sample for delivery after a first sample has been delivered to the transfer line. Additionally, in a preferred embodiment, the injector system delivers the sample to the transfer line at a flow rate which is greater than the rate of the low flow delivery of the solvent solution.

In another preferred embodiment, the method further includes the step of directing a gas at a distal end of the electrospray ionization sprayer to remove any droplets which may be present at the distal end before the electrospray ionization sprayer is energized.

Still other objects and advantages of the present invention will become readily apparent to those skilled in the art from the following detailed description wherein several embodiments are shown and described. As will be realized, the invention is capable of other and different embodiments, and its several details are capable of modifications in various respects, all without departing from the invention. Accordingly, the drawings and description are to be regarded as illustrative in nature, and not in a restrictive or limiting sense, with the scope of the application being indicated in the claims.

BRIEF DESCRIPTION OF THE FIGURES

For a fuller understanding of the nature and objects of the present invention, reference should be made to the following detailed description taken in connection with the accompanying drawings in which the same reference numerals are used to indicate the same or similar parts wherein.

DETAILED DESCRIPTION OF THE PREFERRED EMBODIMENTS

The present disclosure is directed to systems and methods that utilize a parallel high-throughput screening (HTS) strategy to quickly identify, via mass spectrometric analysis, the presence of a small compound, or compounds, within prepared samples. The present disclosure may have broad applications in high throughput mass spectrometry as pertains to high throughput screening, automated analysis, and quality control. The present disclosure describes systems and methods for high throughput electrospray ionization (ESI) in which an ESI sprayer can be coupled to a control module in which sample flow rates, buffer flow rates, nebulizing gas, and ionization voltages can be synchronized (via the control module) to enable rapid sample transfer to the ionization source (e.g., an ESI sprayer).

The systems and methods described herein, therefore, may enable significant improvement in sample throughput, allowing a greater number of samples to be analyzed in a given period of time. Operation in a low flow sample delivery mode may provide improved sensitivity as the ESI process is generally more efficient at low flow rates, and because the analysis of a given volume of sample can then be signal-averaged for extended intervals, thereby providing improved signal-to-noise detections. In addition to enabling more rapid analysis of analytes (i.e., samples) or mixtures of analytes, operation of the ESI source in a voltage-gated mode, where a voltage is applied to the ESI source only when data acquisition is taking place, may result in reduced source fouling as the ESI plume is generated (and sampled) only during the period of data acquisition (by a MS/Data acquisition system). Reduced source fouling can translate to directly reducing instrument down time which results from the cleaning and maintenance of the ionization source components.

Figure 1:
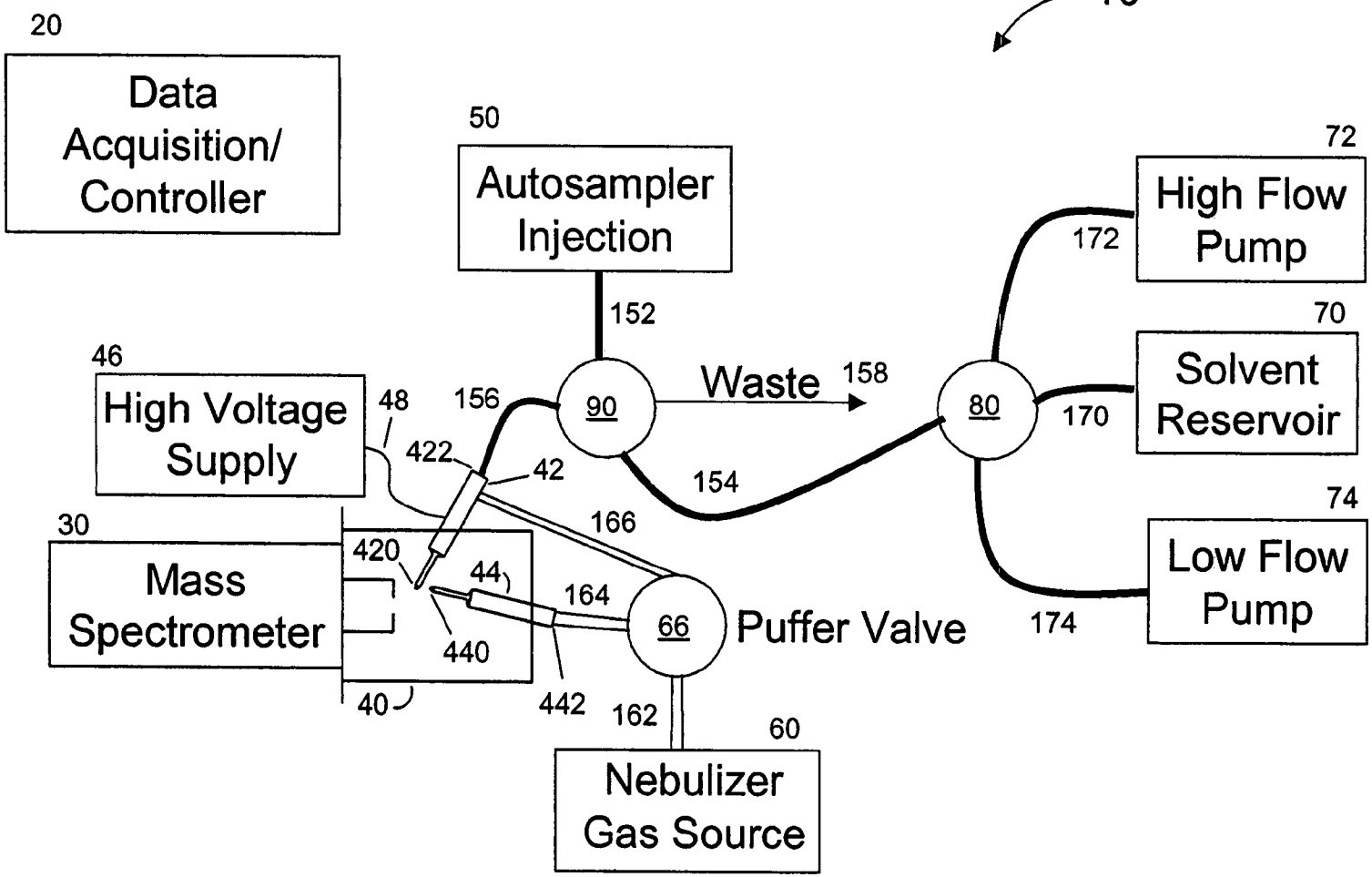
FIG. 1 depicts an exemplary embodiment of a system in accordance with the present disclosure.

In accordance with the present disclosure, FIG. 1 illustrates an exemplary embodiment of a system 10 which has a solvent reservoir 70, a high flow pump 72, a low flow pump 74, a fluidic valve 80 and an injection valve 90. The solvent reservoir 70 of system 10 can contain a solvent solution that is suitable for operation in an ESI source environment. In a preferred embodiment, the solvent solution of the system 10 is the same as the ESI buffer material that is used in the autosampler injection system 50 (discussed below). Persons skilled in the art will readily recognize that the selection of the solvent solution/ESI buffer material may, to a great extent, depend upon the chemical composition of the samples to be tested (i.e., subjected to mass spectrometric analysis). For example, while an exemplary embodiment may use a solvent solution composed of 33% Isopropanol and 67% water with 100 mM Ammonium Acetate, persons skilled in the art will readily recognize a wide of variety of other solvent solutions that may also be used without departing from the scope of the present disclosure. The solvent reservoir 70, high flow pump 72 and low flow pump 74 are coupled to the fluidic valve 80 via solvent lines 170, 172 and 174, respectively. As depicted in FIG. 1, the injection valve 90 is coupled to the fluidics valve 80 by solvent line 154. The solvent lines 154, 170, 172 and 174, which have an inner diameter that should be appropriately sized to handle the solvent solution delivered to and from the high flow pump 72 and low flow pump 74, can be a wide variety of line types, such as a hose, pipe, tube, conduit etc.

The high flow pump 72 and low flow pump 74 each can deliver a highly accurate volume of solvents solution to solvent lines 172, 174 (and beyond), respectively. The high flow pump 72 has a volume discharge that is substantially greater over the same period of time than that of the low flow pump 74. In an exemplary embodiment in accordance with the present disclosure, the high flow pump 72 and low flow pump 74 are highly accurate syringe pumps and, in a preferred embodiment, the high flow pump 72 and low flow pump 74 are programmable syringe pumps, model number 74901-10 available from Cole-Parmer Instrument Company of Vernon Hills, Ill., having a 500 μL and 50 μL syringe reservoirs, respectively. The syringe body (not shown) of the high flow pump 72 acts as an internal solvent reservoir. The depression of a plunger (not shown) within the syringe body can cause the solvent solution contained within the syringe body to be pumped into solvent line 172 and, depending upon the configuration of the fluidics valve 80, into fluidics valve 80 and solvent line 154 and beyond. Thus, the high flow pump 172 can generate a positive pumping pressure, and the discharge volume and flow rate of the solvent solution can be accurately controlled by appropriately regulating the stroke of the high flow pump's plunger. As is discussed in greater detail below, the syringe body of the high flow pump 72 may then be refilled with solvent solution (for a later high flow use) from the solvent reservoir 70 by at least partially displacing the plunger from the high flow pump's syringe body. The withdrawing of the high flow pump's 72 plunger can cause some of the solvent solution that is present in the solvent reservoir 70 to flow, via solvent line 170, fluidics valve 80 and solvent line 172, into the syringe body of the high flow pump 72. The low flow pump 74 may be similarly controlled to pump solvent solution into solvent line 174 (and beyond) and to draw solvent solution from the solvent reservoir 70 via solvent line 170, fluidics valve 80 and solvent line 174.

As stated, the high flow pump 72 and the low flow pump 74 of system 10 can pump solvent solution by applying a positive pumping pressure to solvent lines 172 and 174, respectively, to the fluidics valve 80 and, depending upon the configuration of the fluidics valve 80, to the injection valve 90 (and beyond) via solvent line 154. The pumping pressures generated by the high flow pump 72 will generally be substantially greater than the pumping pressures generated by the low flow pump 74. Accordingly, the high flow pump 72 may generate a higher flow of solvent solution to the fluidics valve 80 (and beyond, depending upon the configuration of the fluidics valve 80) than the low flow pump 74.

In an exemplary embodiment, the fluidics valve 80 and the injection valve 90 are two-position multi-port fluid processors. Thus, each valve 80 and 90 can have two positions, the configuration of which may be controlled by the data acquisition/controller 20, as discussed below. In a preferred embodiment in accordance with the present disclosure, the fluidics valve 80 can be a two-position, six-port fluid processor, model number AVO-6084 available from Phenomenex of Torrance, Calif., while the injection valve 90 can be a two-position, ten-port fluid processor, model number 100.LC102H available from Leap Technologies, Inc. of Carrboro, N.C.

System 10 further includes an autosampler injection system 50, a high voltage supply 46, a nebulizer gas source 60, an electrospray ionization chamber 40 and an electrospray ionization (ESI) sprayer 42, which is at least partially located within an electrospray ionization chamber 40. The autosampler injection system 50 of system 10 can be a wide variety of commercially available conventional automated injection systems, such as the CTC HTS PAL autosampler available from LEAP Technologies, Inc. of Carrboro, N.C. Such an autosampler injection system 50 may have a programmable robotic injection sample delivery system having an internal reservoir of solvent solution/ESI buffer. It can extract samples from 96-well microtiter plates and inject a sample into a 10 μL sample loop integrated with an internal fluidics handling system which allows differential control of the sample/buffer flow rate.

In alternate exemplary embodiment of the systems and methods described herein, the electrospray ionization chamber 40 and an electrospray ionization (ESI) sprayer 42 of system 10 may be substituted with an atmospheric-pressure chemical ionization chamber and an atmospheric-pressure chemical ionization sprayer, respectively, without departing from the scope of the present disclosure.

As shown in FIG. 1, the autosampler injection system 50 is coupled to the injection valve 90 via transfer line 152 and the proximal end 422 of the electrospray ionization (ESI) sprayer 42 is coupled to the injection valve 90 via transfer line 156. A waste line 158 for discharging waste solvent solution and/or excessive samples is also shown as being coupled to the injection valve 90. Transfer lines 152, 156 and waste line 158, have inner diameters that should be appropriately sized to handle the solvent solution and sample (and/or sample/buffer solution) that these lines may be subjected to. These lines may comprise a wide variety of line types, such as a hose, pipe, tube, conduit etc, which are suitable for handling the solvent solution and sample (and/or sample/buffer solution).

The high voltage supply 46 may provide an energy supply to the ESI sprayer 42 via electrical line 48. The distal end 420 of the ESI sprayer 42 is located within the electrospray ionization chamber 40. The electrospray plume (or bead) 460 [see FIG. 5*c*] containing the sample which has been ionized can be generated at or near the distal end 420 of the ESI sprayer 42 through the application and delivery of a sample (delivered via transfer line 156), a nebulizer gas (e.g., via nebulizer gas source 60, puffer valve 66 and conduit 166) and a voltage potential (via high voltage supply 46 and electrical line 48), to the ESI sprayer 42, as is well known in the art. The electrospray plume 460, thus, for example, can be produced by applying a strong electrical field, under atmospheric pressure, to the sample as it passes through the ESI sprayer 42 (e.g., a capillary tube, not shown) with a low flow rate. The high voltage supply 46, electrical line 48, nebulizer gas source 60, electrospray ionization chamber 40 and ESI sprayer 42, are often included in a system that is collectively referred to as an electrospray ionization source. The electrospray ionization source of the present disclosure can be a wide variety of commercially available sources such as an APOLLO ElectroSpray Ionization Source available from Bruker Daltonics, Inc. of Billerica, Mass.

System 10 of FIG. 1 further includes a puffer valve 66, a gas puffer 44 and conduits 162, 164 and 166. While the puffer valve 66 and gas puffer 44 (and conduits) are not essential to the systems and process of delivering samples to the ESI sprayer 42, the presence of the these within system 10 may improve the efficiencies and operation of the ESI sprayer 42, the mass spectrometer 30 and/or data acquisition/controller 20. The puffer valve 66 and gas puffer 44 can facilitate the removal of a droplet 450 (see FIG. 5) which may be present at the distal end 420 of the ESI sprayer 42 by directing an airflow (e.g., a nebulizer gas) to the distal end 420. If a droplet 450 is attached to the distal end 420 of the ESI sprayer 42 when a voltage is applied to the ESI sprayer 42, the droplet 450 may become detached from the ESI sprayer 42 and, due to the attractive electrostatic forces between the charged droplet 450 and the oppositely charged inlet of the mass spectrometer 30, the droplet 450 may be discharged into the electrospray ionization chamber 40 and the mass spectrometer 30. The introduction of the droplet 450 into the electrospray ionization chamber 40 and/or mass spectrometer 30 can have a detrimental impact on MS performance owing to a concomitant pressure burst in the electrospray ionization chamber 40 and the other vacuum stages (not shown) of the mass spectrometer 30. This is especially relevant for high performance mass spectrometers such as ESI-FTICR and ESI-TOF platforms in which low operating pressure is a prerequisite for high performance measurements.

As shown in FIG. 1, the nebulizer gas source 60 is coupled to the puffer valve 66 via conduit 162 and the puffer valve 66 is coupled to the proximal end 422 of the gas puffer 44 and the ESI sprayer 42 via conduits 164 and 166, respectively. In a preferred embodiment, the nebulizer gas source 60 contains a dry nitrogen gas, however, persons skilled in the art will readily recognize a wide variety of nebulizer gases which may be used without departing from the scope of the present disclosure. The distal end 440 of the gas puffer 44 is located within the electrospray ionization chamber 40 and aligned with the distal end 420 of the ESI sprayer 42. Conduits 162, 164 and 166 carry the nebulizer gas to their respective destinations while the puffer valve 66 can control the delivery of the nebulizer gas from the nebulizer gas source 60 to the gas puffer 44 and the ESI sprayer 42, as is discussed in detail below. Conduits 162, 164 and 166 may be pipes, tubes, hoses, or any type of line which is suitable to carrying the nebulizer gas.

The system 10 of FIG. 1 also includes a data acquisition/controller 20 and a mass spectrometer 30. The data acquisition/controller 20 can analyze and determine the masses of the ionized samples that have been detected by the mass spectrometer 30. Additionally, in an exemplary embodiment, the data acquisition/controller 20 can also control the operation of the fluidics valve 80, the high flow pump 72, the low flow pump 74, the injection valve 90, the autosampler injection system 50, the ESI sprayer 42, the nebulizer gas source 60, the puffer valve 66, the high voltage supply 46 and/or the mass spectrometer 30. The data acquisition/controller 20 may control these components of the system 10 via synchronized control commands, such as a TTL pulse, for example, which can be delivered to these components via command control lines (not shown). Thus utilization of TTL pulses, for example, can allow the data acquisition/controller 20 to control the critically timed events presented in exemplary method 200 of FIG. 2, for example. For example, the data acquisition/controller 20 may control the configuration (or position) of the fluidics valve 80 by sending a TTL pulse to the fluidics value 80 or, similarly, may energize the ESI sprayer 42 by sending a TTL pulse to the high voltage supply 46.

While the data acquisition/controller 20 and the mass spectrometer 30 are illustrated as separate components or devices, in practice they may be components of a single device or system. For example, one data acquisition/controller 20 combined with a mass spectrometer 30 is the Apex II 70*e* electrospray ionization Fourier transform ion cyclotron resonance (FTICR) mass spectrometer with an actively shielded seven telsa superconducting magnet, which is available from Bruker Daltonics, Inc. of Billerica, Mass. However, persons skilled in the art will readily recognize a wide variety of mass spectrometer and data acquisition/control systems may be used without departing from the scope of the present disclosure. As shown, the mass spectrometer 30 is coupled to the electrospray ionization chamber 40 so as to receive, process and detect the delivered ionized samples.

Figure 2:
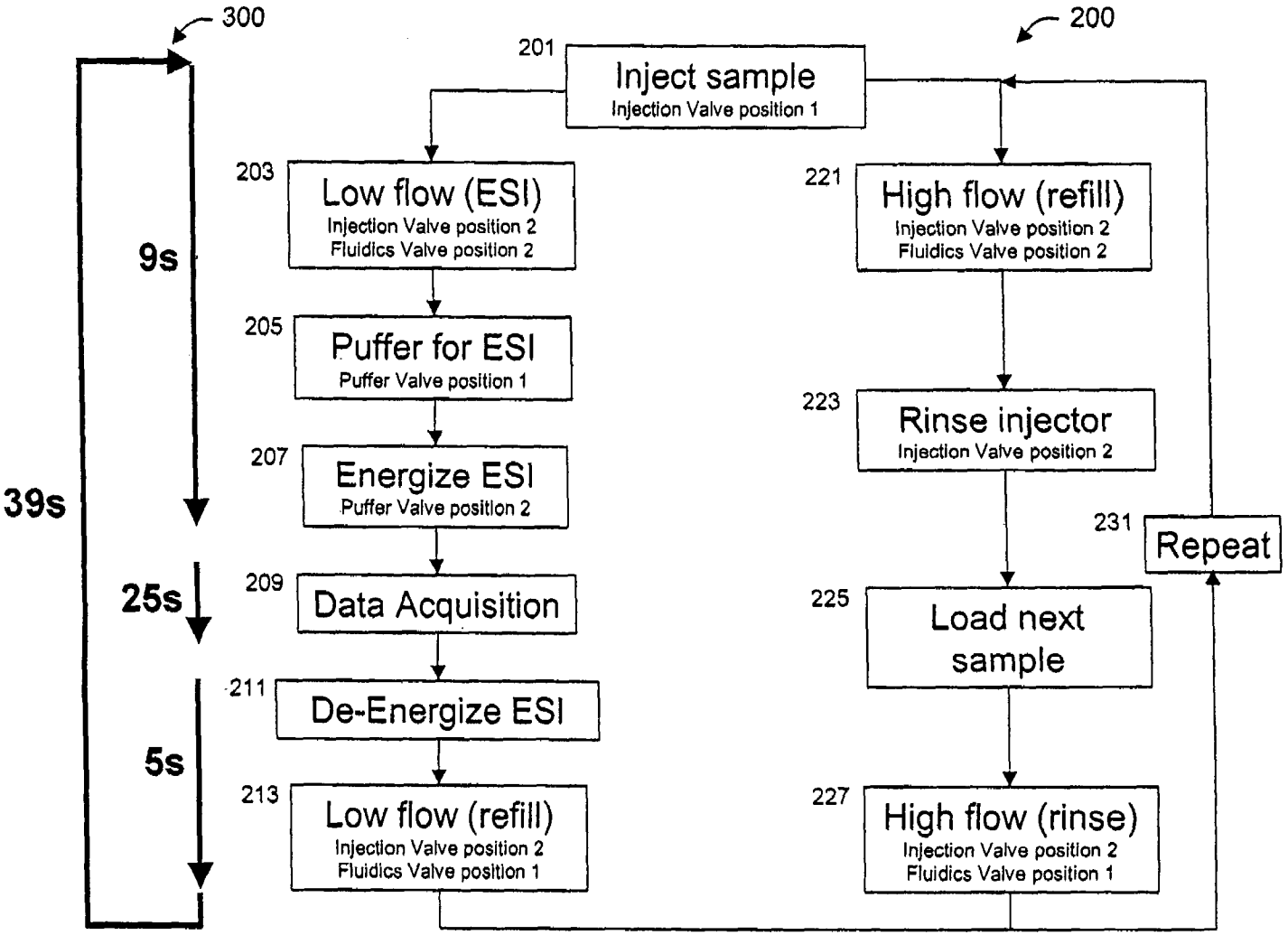
FIG. 2 illustrates an exemplary embodiment of a method in accordance with the present disclosure with an accompanying exemplary timeline.

To emphasize different details, FIG. 2 depicts a flowchart of an exemplary method 200 for generating electrospray ionized samples for mass spectrometric analysis in accordance with the present disclosure. FIG. 2 further depicts a timeline 300 which illustrates the time durations that may be required to complete the steps detailed in method 200. At a high level, method 200 illustrates the parallel nature of the system in that, in accordance with the present disclosure, certain components of the system may be involved in one process (e.g., rinsing) while other components in the system may be involved in other processes (e.g., data acquisition). Method 200 may begin at an injection of a sample, step 201. Once a sample has been injected, the electrospray ionization low flow, step 203 may be initiated. Shortly after the initiation of step 203, a puffer gas of a short duration may be delivered to the distal end 420 of the ESI sprayer 42, step 205, which may then be quickly followed by energizing the ESI sprayer 42 (via the high voltage supply 46) and delivering the nebulizer gas to the ESI sprayer (via puffer valve 66), step 207.

Once step 207 has been completed (i.e., the ESI sprayer 42 is energized and receiving the nebulizer gas), electrospray ionization of the injected sample and data acquisition may begin, step 209. In a preferred embodiment, as illustrated in timeline 300, the accomplishment of steps 201, 205 and 207 and the initiation of step 203 (such that step 209 may begin) may require approximately nine seconds. In a preferred embodiment, step 209 may take approximately 25 seconds to complete. After step 209 has been completed, the ESI sprayer 42 may be de-energized and the delivery of the nebulizer gas to the ESI sprayer may be stopped, step 211. Once the ESI sprayer 42 is de-energized, step 211, the electrospray ionization low flow step 203 may then be completed (i.e., terminated) and the low flow refill of the low flow pump 74, step 213, and the high flow rinse, step 227, may be initiated. In a preferred embodiment, after data acquisition step 209 is completed, the ESI sprayer 42 is immediately de-energized, step 211, and the fluidics valve 80 is switched to high flow rinse, step 227. Additionally, the low flow pump 74 may continue to run for 1–2 seconds after the fluidics valve 80 switches to ensure that data acquisition, step 209, is complete—the low flow pump 74 may then immediately begins its re-fill cycle, step 213. While method 200 depicts steps 211 and 213 as occurring serially, in some embodiments in accordance with the present disclosure, steps 211 and 213 may occur in parallel. In a preferred embodiment, as depicted in FIG. 2, the initiation and completion of steps 211 and 213, either serially or in parallel, can require approximately 5 seconds. Once step 213 has been completed, the steps of method 200 may be repeated (step 231) with the next sample to be tested.

Concurrent with step 203 (and possibly preceding it), the high flow refill of the high flow pump 72, step 221, may be initiated and when completed, the rinsing of the sample injector (not shown) which is internal to the autosampler injection system 50 may then subsequently be initiated, step 223. Once the sample injector has been rinsed, step 223, the next sample to be tested can be obtained by the sample injector of the autosampler injection system 50, step 225, in anticipation of sample injection, step 210. and the high flow rinse, step 227, may be initiated. While method 200 of FIG. 2 depicts steps 225 and 227 as occurring serially, in some embodiments in accordance with the present disclosure, steps 225 and 227 may occur in parallel. In a preferred embodiment, the completion of the high flow rinse step 227 may take approximately 3–5 seconds.

Figure 3:
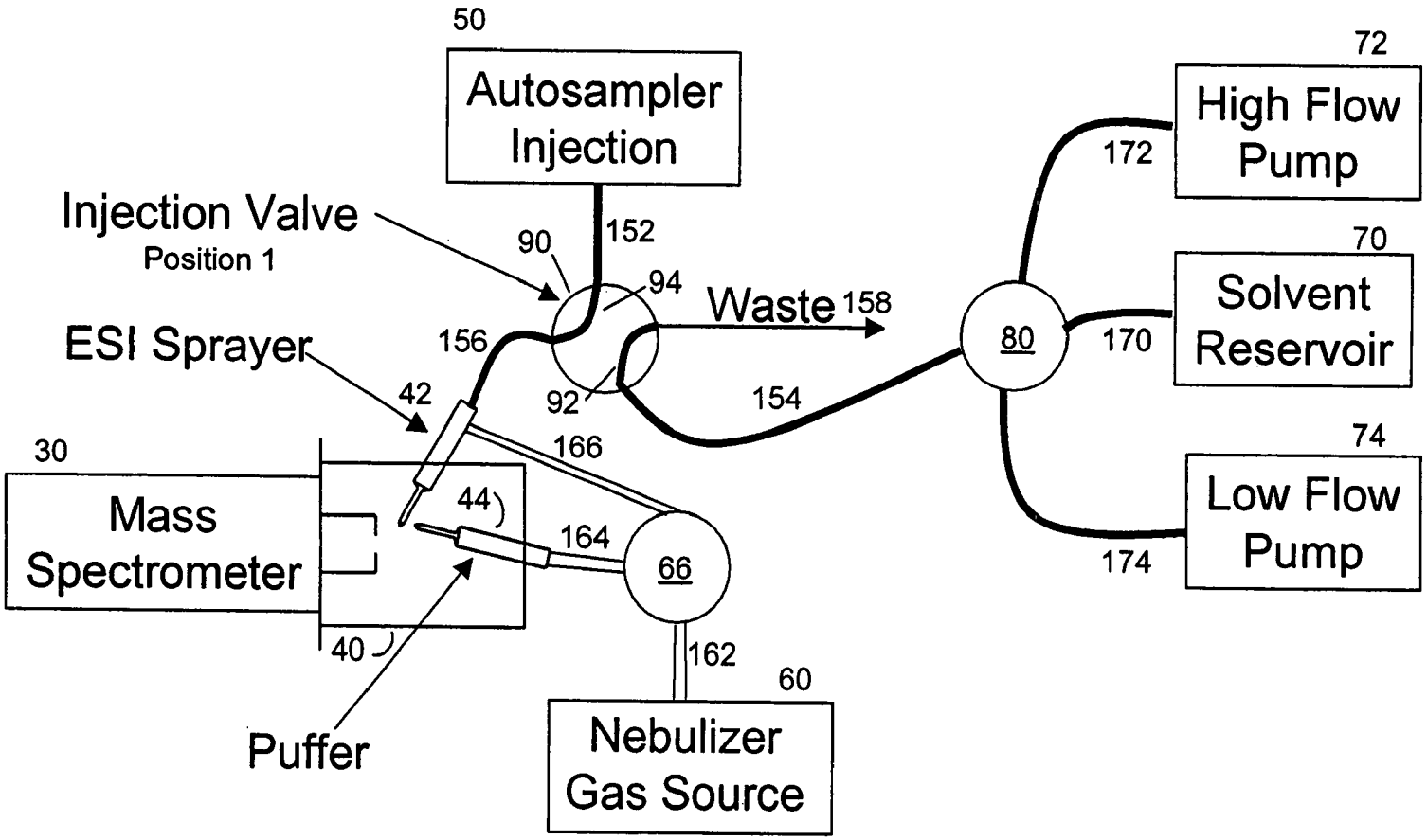
FIG. 3 depicts the exemplary embodiment of FIG. 1 with additional details in accordance with the present disclosure.

FIG. 3 illustrates one embodiment of how step 201, the injection of the sample to be tested, may be accomplished in accordance with the present disclosure. As previously stated, in a preferred embodiment, the injection valve 90 of system 10 is a two-position multi-port fluid processor. FIG. 3 depicts the injection valve 90 configured to a first position. When the injection valve 90 is configured to its first position (e.g., by a TTL pulse coming from the data acquisition/controller 20), a sample may be transferred from the autosampler injection system 50 to the transfer line 156 via the transfer line 152 and the position I pathway 94 of the injection valve 90. Quicker delivery of the sample from the autosampler injection system to the transfer line 156 may be accomplished by utilizing a delivery flow rate (produced by the autosampler injection system 50) that is compared to the delivery flow rates which can be produced by the high flow pump 72, as discussed below. Upon the completion of step 201, the sample that is to be subjected to electrospray mass spectrometric analysis is loaded into the transfer line 156.

Figure 4:
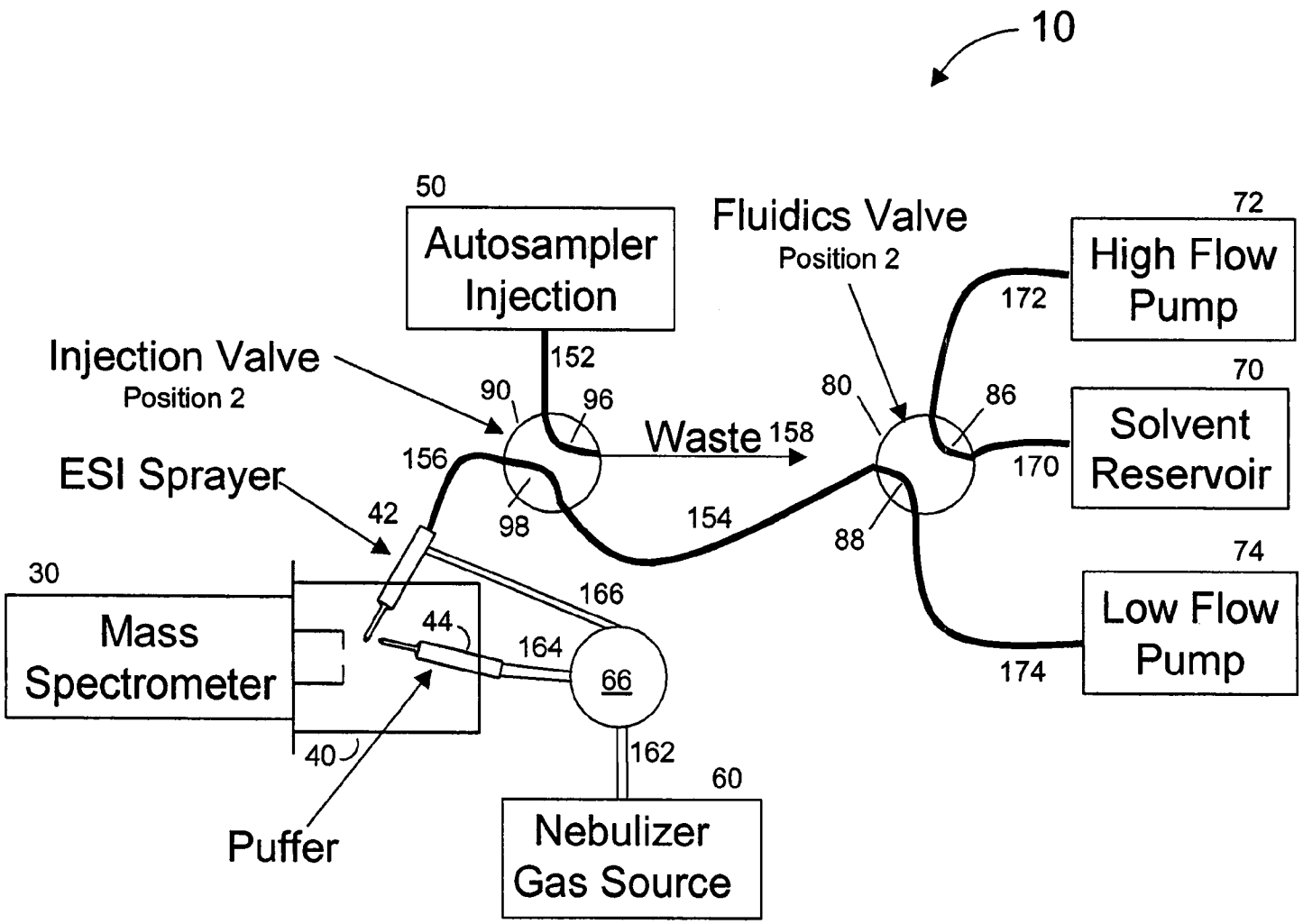
FIG. 4 also depicts the exemplary embodiment of FIG. 1 with additional details in accordance with the present disclosure.

FIG. 4 depicts one embodiment that is illustrative of how the low flow pumping of the solvent solution by the low flow pump 74 (step 203) and the refilling of the high flow pump 72 with solvent solution from the solvent reservoir 70 (step 221) can be accomplished in accordance with the present disclosure. FIG. 4 depicts the injection valve 90 of system 10 configured to a second position, and the fluidics valve 80 of system 10 also configured to a second position. To begin the electrospray ionization low flow process, step 203, the injection valve 90 needs to be reconfigured from its first position to its second position, e.g., via a TTL pulse delivered from the data acquisition/controller 20 to the injection valve 90. In addition, the fluidics valve 80 also needs to be in its second position.

Commensurate (or approximately commensurate) with the repositioning of injection valve 90, the low flow pump 74 may be commanded to pump a previously established volume of solvent solution (e.g., ESI buffer). The pumping forces from the low flow pump 74 cause a pre-determined volume of solvent solution to be pumped, via solvent line 174, the position 2 pathway 88 of the fluidics valve 80, solvent line 154 and the position 2 pathway 98 of the injection valve 90, toward and to transfer line 156. The volume of solvent solution that is to be pumped by the low flow pump 74 was pre-determined, based upon this pathway, so as to achieve a desired flowrate identified for optimal and efficient ESI performance of approximately 70 μL/Hr. However, the recitation of this low flow rate should not be construed as limiting the scope of the present disclosure; persons skilled in the art will readily recognize a wide range of low flow rates that are within the scope of the present disclosure and that are conducive to accurate and efficient electrospray ionization mass spectrometric analysis. Thus, the low flow pump 74 is responsible for delivering a regulated (low) flow of the sample from the transfer line 156 to the electrospray ionization source so as to facilitate the electrospray ionization of the sample.

In a preferred embodiment, the operations of step 221, the high flow refill of the high flow pump 72, overall, at least partially, with the operations of step 203, the low flow delivery of solvent solution from the low flow pump 74 to the transfer line 156. In some embodiments, step 221, or a portion thereof, may also be conducted concurrently with step 201 (or a portion thereof), the delivery of the sample from the autosampler injection system 50 to the transfer line 156. As depicted in FIG. 4, step 221 involves the refilling the high flow pump 72 with solvent solution stored in the solvent reservoir 70. To accomplish this, the fluidics valve 80 is configured to position 2, and then the high flow pump 72 is commanded to draw a vacuum, e.g., by withdrawing the plunger from the syringe body of the high flow pump 72. As previously described, the operation of the fluidics valve 80 and high flow pump 72 may be controlled via appropriate commands, e.g. TTL pulses, from the data acquisition/controller 20. By having the high flow pump 72 create a vacuum while in this valve configuration, solvent solution can be drawn from the solvent reservoir 70 and delivered to the high flow pump 72 via solvent line 170, the position 2 pathway 86 of the fluidics valve 80 and solvent line 172 so as to refill the high flow pump 72.

Commensurate with step 221, or alternatively, occurring thereafter, the injector (not shown) of the autosampler injection system 50 may be rinsed, step 223, in anticipation of loading the next sample within the autosampler injection system 50. Prior to preparing the next sample for delivery, the autosampler injection system 50 flushes the internal components that are exposed to the presence of a sample with a solvent solution (e.g., ESI buffer). The discharge of this solvent solution from the autosampler injection system 50 can be directed by the autosampler injection system 50, which may or may not be controlled by data acquisition/controller 20 to a waste receptacle (not shown), which may be reached via transfer line 152, the position 2 pathway 96 of the injection valve 90 and waste line 158.

The internal loading of the next sample to be tested/evaluated within the autosampler injection system 50, step 225, can then be conducted once step 223 has been completed.

Figures 5, 5A, 5B, 5C:
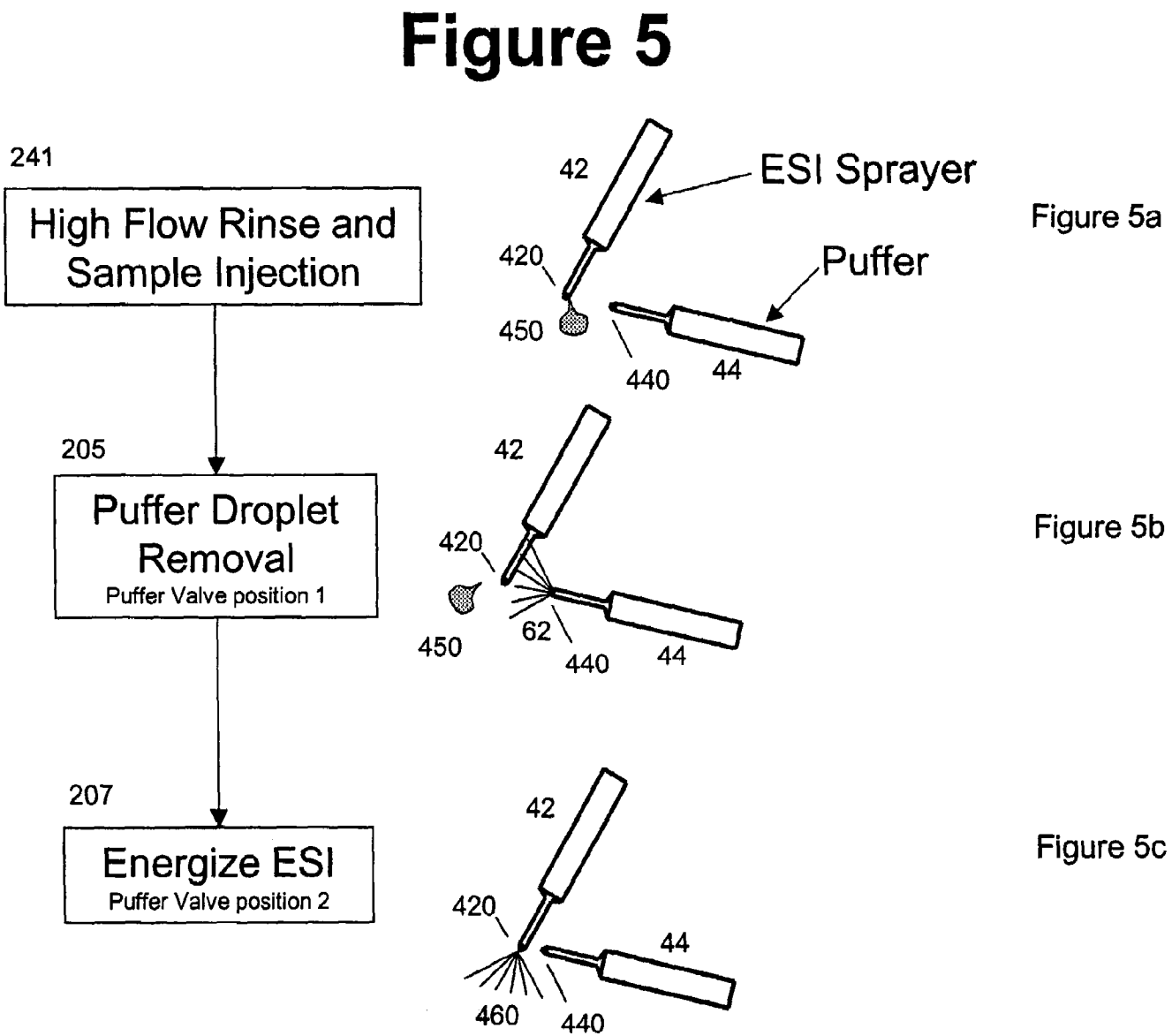
FIG. 5 depicts exemplary embodiments of an electrospray ionization sprayer and a gas puffer in accordance with the present disclosure.
Figure 6:
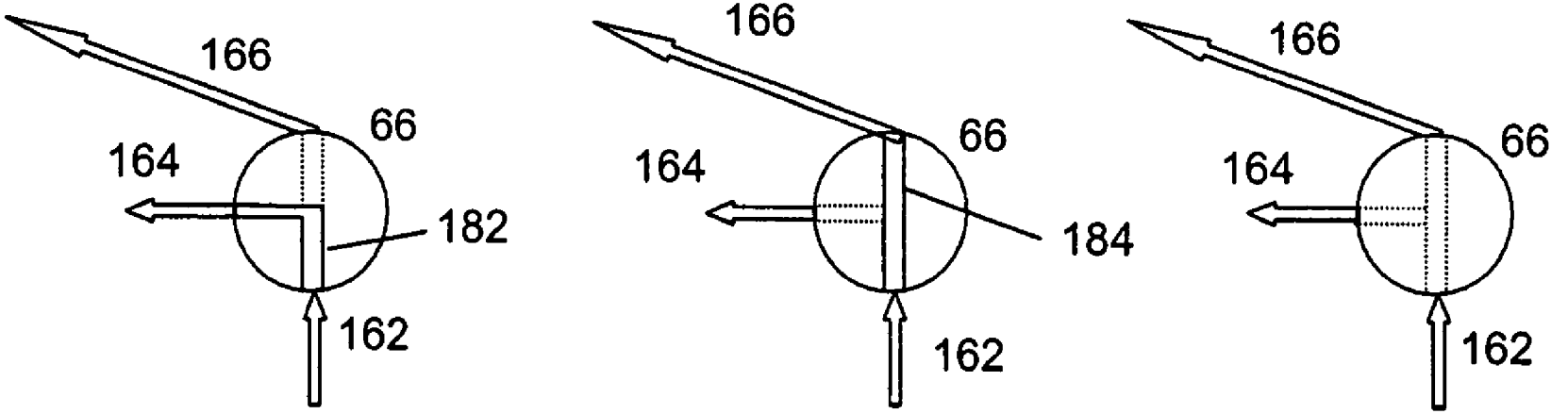
FIG. 6 depicts an exemplary embodiment of a puffer valve in accordance with the present disclosure.

FIGS. 5 and 6 illustrate an one embodiment of how steps 205 and 207 can be accomplished in accordance with the present disclosure. FIG. 5 depicts exemplary embodiments of an ESI sprayer 42 and a gas puffer that can be arranged within an electrospray ionization chamber 40, while FIG. 6 illustrates an exemplary embodiment of a puffer valve 66. The puffer valve 66 and gas puffer 44 may facilitate the removal of a droplet 450, which may be present at the distal end 420 of the ESI sprayer 42, by directing a puff of air (e.g., nebulizer gas) toward the droplet 450. As shown in FIGS. 1 and 6, the nebulizer gas source 60 can be coupled to the puffer valve 66 via conduit 162 and the puffer valve 66 can be coupled to the proximal end 422 of the gas puffer 44 and to the ESI sprayer 42 via conduits 164 and 166, respectively. In a preferred embodiment, the distal end 440 of the gas puffer 44 is positioned (i.e., aligned) within the electrospray ionization chamber 40 relative to the ESI sprayer 42 so that a gas stream at the distal end 440 of the gas puffer 44 may cause a droplet which may be present at the distal end 420 of the ESI sprayer 420 to become detached. Referring now to FIGS. 5*a* and 6*c*, the nebulizer gas can be gated off during sample injection (step 201) and high flow rinsing (step 227), e.g., by a TTL pulse from the data acquisition/controller 20. Therefore, as shown in FIG. 6*c*, when the puffer valve 66 is gated off, no nebulizer gas can flow to the conduits 164 and 166 (and thus no nebulizer gas reaches the gas puffer 44 or the ESI sprayer 42).

Immediately after, or concurrent with, the initiation of the introduction of the ESI solvent solution/buffer low flow, step 203 (not shown in FIG. 5), the distal end 420 of the ESI sprayer 42 can be exposed to a short burst of a puffer gas 62, step 205. To accomplish this, as shown in FIGS. 6*b* and 6*a*, the puffer valve 66 may be commanded to a first position which then permits the nebulizer gas to flow via the conduit 162, pathway 182 (within the puffer valve 66) and conduit 164, into the gas puffer 44 and exit (i.e., as indicated by puffer gas 62) from the distal end 440 of the gas puffer 44 which can cause the solvent droplet 450 to become detached from the distal end 420 of the ESI sprayer 42.

After the completion of step 205, the puffer valve 66 may then be switched (e.g., commanded) to a second position to divert the delivery of the nebulizer gas to the ESI sprayer 42 and the ESI sprayer 42 may then be energized via the high voltage supply 46 (e.g., via a TTL pulse from the data acquisition/controller 20), step 207. Thus, in this exemplary embodiment as shown in FIGS. 5*c* and 6*b*, the nebulizer gas can flow from the nebulizer gas source 60 to the ESI sprayer 42 via conduit 162, pathway 184 (within the puffer valve 66) and conduit 166. Thus, upon the introduction of the nebulizer gas within the ESI sprayer 42 (and the introduction of the sample and voltage potential etc.) an electrospray plume (or bead) 460 can be generated at or near the distal end 420 of the ESI sprayer 42 within the electrospray ionization chamber 40. Once the electrospray plume has been generated within the electrospray ionization chamber 40, data acquisition regarding the sample, step 209, may then be accomplished by the mass spectrometer 30 and data acquisition/controller 20.

Figure 7:
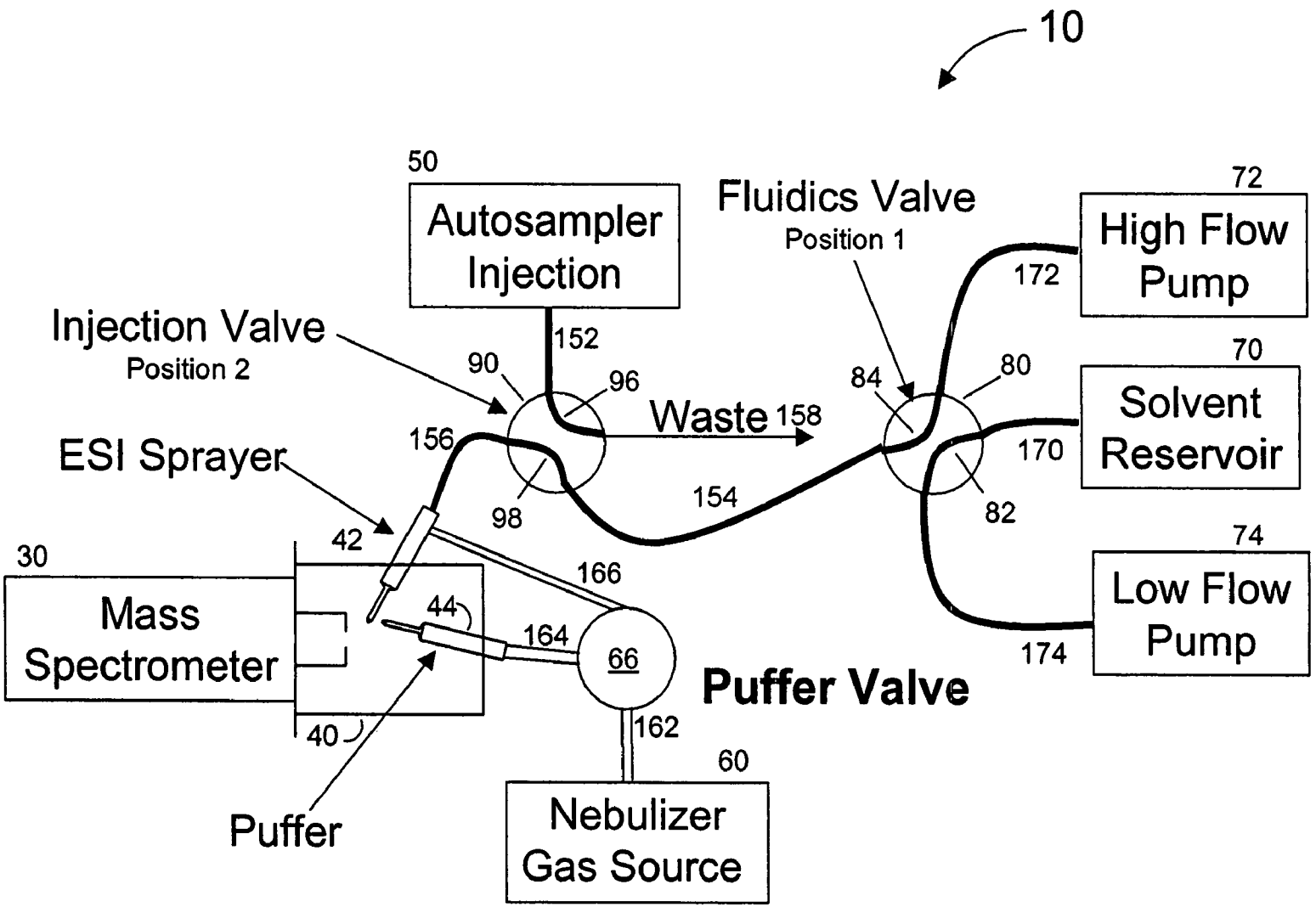
FIG. 7 further depicts the exemplary embodiment of FIG. 1 with additional details in accordance with the present disclosure.

FIG. 7 illustrates one exemplary embodiment of how step 213, the refilling of the low flow pump 74, and step 227, the high flow rinsing of the transfer line 156, may be accomplished in accordance with the present disclosure. FIG. 7 depicts the injection valve 90 of system 10 configured to a second position and the fluidics valve 80 of system 10 configured to a first position. Once the ESI sprayer 42 has been de-energized and, optionally, the flow of the nebulizer gas to the ESI sprayer 42 has been terminated, the transfer line 156 (and, optionally, the electrospray ionization sprayer 42) needs to be flushed before the next sample is introduced into the transfer line 156. In accordance with the present disclosure, this may be accomplished by flushing transfer line 156 with a solvent solution that is pumped at a high flow rate from the high flow pump 72, step 227. After the delivery of the low flow solvent solution, step 203, has been completed, the fluidics valve can be configured to its first position. Then, optionally, once the ESI sprayer 42 has been de-energized, step 211, high flow pump 72 can be commanded to deliver a pre-determined volume of the solvent solution at a high flow rate. With the system 10 configured as shown in FIG. 7, the pumping forces of the high flow pump 72 cause the pre-determined volume of solvent solution to be pumped, via solvent line 172, through the position 1 pathway 84 of the fluidics valve 80, solvent line 154 and the position 2 pathway 98 of the injection valve 90, toward and to transfer line 156, thereby flushing the transfer line 156. In preferred embodiments in accordance with the present disclosure, the high flow rate of the high flow pump 72 (and, optionally, the delivery flow rate of the autosampler injection system 50) is approximately 33,000 μL/Hr (as compared to the low flow rate of 70 μL/Hr provided by the low flow pump 74 that is used for data acquisition). At such high flow rates, the high flow rinse interval (nine seconds, which corresponds to a rinse volume of 83 μL) may minimize carryover between samples to less than 3%. If performed entirely at the low flow rates (incorporating the same rinse volume), the rinse-cycle time, step 227, would take over an hour. Alternatively, if the entire system operated at high flow rates, only one spectrum could be acquired during in the interval in which the sample passes through the electrospray ionization source. By using the dual high and low flow-rate scheme of the present disclosure, approximately 60 spectra may be signal-averaged while the sample passes through the ionization volume.

In a preferred embodiment in accordance with the present disclosure, by using known mass spectrometry (MS) technologies such as Fourier Transform Ion Cyclotron Resonance-Mass Spectrometry (FTICR-MS), for example, the HTS strategy can be used to identify the small molecule(s) that bind to a RNA target. Moreover, the HTS strategy disclosed herein can be a key component of a Multitarget Affinity/Specificity Screening (MASS) protocol. A MASS assay can take advantage of the "intrinsic mass" label of each compound and target RNA to screen large mixtures of small molecules against multiple RNA targets simultaneously such that the identity of the small molecule(s) which bind, the RNA target to which it binds, the compound-specific binding affinity, and the location of the binding site on the RNA can each be determined in one set of rapid experiments.

At the core of the MASS approach is the premise that in a solution containing multiple targets and multiple ligands (i.e., a sample), the molecular interaction between any given target-ligand combination is independent of the presence (or absence) of the other ligands and targets in solution. The applicants have demonstrated that in a mixture of 3 targets and 26 ligands, that a ligand binding a specific RNA will do so in the presence of the other ligands even at a significantly lower concentration than the total concentration of the other ligands. Accordingly, the present disclosure encompasses systems and methods for automating the MASS assay into a multiply-parallel high throughput format. For example, in accordance with the present disclosure, a sample (e.g., a solution containing at least one RNA target and at least one ligand), can be injected to a mass spectrometer and mass analyze every 39 seconds. During the 39 seconds, spectra can be co-added while the autosampler injection systems is rinsing its internal syringe, sample loop and injector and preparing to inject the next sample. Typically, 25 compounds at 50 uM each are screened against 3 targets at 5 uM each. In this mode 75 molecular interactions can be evaluated every 39 seconds which corresponding to approximately 0.52 seconds/analysis. In this way, in less than 7 hours, 6 microtiter plates can be analyzed which allows >40,000 molecular interactions to be evaluated. Therefore, a tremendous amount of mass spectrometry data can be generated in a short period of time in accordance with the present disclosure. In the gated automated approach of the present disclosure, tens of thousands of molecular interactions, for example, may be interrogated in a single day.

Since numerous embodiments may be used to achieve the above systems and methods without departing from the scope of the present invention, it is intended that all matter contained in the above description or depicted in the accompanying drawings shall be interpreted as merely illustrative and not limiting the scope of the invention, which is set forth in the following claims.

What is claimed is:

1. A system for delivering samples for high throughput mass spectrometric analysis, the system comprising:

a reservoir containing a solvent;

a first valve coupled to the reservoir; and a first pump and a second pump for pumping the solvent, the first and second pumps being coupled to the first valve a delivery flow rate of the first pump being greater than a delivery flow rate of the second pump, wherein the first pump is used to flush a sample transfer line with the solvent, and the second pump is used to cause solvent to push samples that have been preloaded from a sample source into the sample transfer line to be delivered through the sample transfer line for analysis.

2. A system in accordance with claim 1, wherein the transfer line is coupled to an atmospheric-pressure ionization source.

3. A system in accordance with claim 2, wherein the atmospheric-pressure ionization source is at least one of the following: an electrospray ionization source and an atmospheric-pressure chemical ionization source.

4. A system in accordance with claim 1, further comprising a controller to control at least one of the following: the first valve, the first pump, and the second pump.

5. A system in accordance with claim 1, further comprising an injection system having a sample injector, wherein the injection system can deliver a sample to the transfer line, and wherein the transfer line is capable of being connected to an atmospheric-pressure ionization source.

6. A system in accordance with claim 1, wherein the first valve consists of a two position, multi-port fluid processor.

7. A system in accordance with claim 1, further comprising a second valve coupled to the first valve.

8. A system in accordance with claim 1, wherein the second pump comprises a programmable syringe pump.

9. A system in accordance with claim 8, wherein the first pump comprises a programmable syringe pump.

10. A system in accordance with claim 9, wherein the first pump has a first volume capacity and the second pump has a second volume capacity and wherein the first volume capacity is greater than the second volume capacity.

11. A system in accordance with claim 1, further comprising an injection system, wherein a delivery flow rate of the injection system is greater than the delivery flow rate of the second pump.

12. A system for generating ionized samples for high throughput mass spectrometric analysis, the system comprising:

a reservoir containing a solvent;

a first pump and a second pump for pumping the solvent, wherein the first and second pumps are coupled to the first valve and wherein a delivery flow rate of the first pump is greater than a delivery flow rate of the second pump;

a second valve coupled to the first valve;

an injection system having a sample injector, wherein the injection system is coupled to the second valve and can deliver a sample to the second valve;

an atmospheric-pressure ionization chamber;

an atmospheric-pressure ionization sprayer coupled to the second valve;

a nebulizer gas source in fluid communication with the atmospheric-pressure ionization sprayer;

a transfer line connected to the second valve, wherein the injection system can deliver a sample to the transfer line via the second valve, and wherein the transfer line is also connected to the atmospheric-pressure ionization sprayer; and a voltage supply source coupled to the atmospheric-pressure ionization sprayer, wherein the first pump is used to flush the transfer line with solvent, and the second pump is used to cause solvent to push samples that have been preloaded from the injection system into the transfer line to be delivered through the transfer line for analysis.

13. A system in accordance with claim 12, wherein the atmospheric-pressure ionization sprayer is at least one of the following: an electrospray ionization sprayer and an atmospheric-pressure chemical ionization sprayer.

14. A system in accordance with claim 13, wherein the atmospheric-pressure ionization sprayer is an electrospray ionization sprayer, and a distal end of the electrospray ionization sprayer is located within the atmospheric pressure ionization chamber.

15. A system in accordance with claim 12, further comprising a controller to control at least one of the following: the first valve, the first pump, the second pump, the second valve and the injection system, the atmospheric-pressure ionization sprayer, the nebulizer gas source and the voltage supply source.

16. A system according to claim 12, wherein the first valve consists of a two position, multi-port fluid processor.

17. A system according to claim 12, wherein the second valve consists of a two position, multi-port fluid processor.

18. A system according to claim 12, wherein the second pump comprises a programmable syringe pump.

19. A system according to claim 18, wherein the first pump comprises a programmable syringe pump.

20. A system according to claim 12, wherein a delivery flow rate of the injection system is greater than the delivery flow rate of the second pump.

21. A system according to claim 12, further comprising:

a puffer valve coupled to the nebulizer gas source and the atmospheric-pressure ionization sprayer; and a gas puffer coupled to the puffer valve, wherein the puffer valve controls the delivery of the nebulizer gas to the atmospheric-pressure ionization sprayer and the gas puffer.

22. A system in accordance with claim 21, wherein a distal end of the gas puffer is located within the atmospheric-pressure ionization chamber and aligned with the distal end of the atmospheric-pressure ionization sprayer.

23. A system according to claim 21, further comprising a controller to control at least one of the the puffer valve and the nebulizer gas source.

24. A method for delivering samples for high throughput mass spectrometric analysis, the method comprising:

A. delivering a sample to a transfer line which can be coupled to an ionization sprayer of an atmospheric-pressure ionization source;

B. initiating a first flow of a buffer solution to the transfer line containing the sample, wherein the first flow of the buffer solution causes the sample to be delivered out of the transfer line;

C. terminating the first flow; and

D. rinsing the transfer line by directing a second flow of the buffer solution to the transfer line, wherein the flow rate of the second flow is greater than the flow rate of the first flow, and wherein the first flow is controlled by a first pump and the second flow is controlled by a second pump.

25. A method in accordance with claim 24, wherein the second pump is filled with the buffer solution during at least a portion of when the first pump is controlling the first flow and wherein the first pump is filled with the buffer solution during at least a portion of when the second pump is controlling the second flow.

26. A method in accordance with claim 24, wherein the transfer line can be coupled to at least one of the following: an electrospray ionization source and an atmospheric-pressure chemical ionization source.

27. A method in accordance with claim 24, wherein the delivering of the sample to the transfer line is controlled by an injector system having a sample injector and further wherein the injector system rinses the sample injector and prepares the next sample for delivery after a first sample has been delivered to the transfer line.

28. A method in accordance with claim 27, wherein the injector system delivers the sample to the transfer line at a flow rate which is greater than the first flow.

29. A method in accordance with claim 24, wherein the transfer line is coupled to an atmospheric-pressure ionization sprayer of an atmospheric-pressure ionization source and wherein the method further comprises:

energizing the atmospheric-pressure ionization sprayer after the initiation of the first flow with a voltage potential and initiating the delivering of a nebulizer gas to the atmospheric-pressure ionization sprayer to generate an ionized plume within the atmospheric-pressure ionization source, wherein the ionized plume consists of at least a portion of the sample which has become ionized;

conducting mass spectrometric analysis of the ionized sample; and de-energizing the atmospheric-pressure ionization sprayer prior to terminating the first flow and terminating the delivery of the nebulizer gas to the atmospheric-pressure ionization sprayer.

30. A method in accordance with claim 29, further comprising directing a gas at a distal end of the atmospheric-pressure ionization sprayer to remove any droplets which may be present at the distal end, wherein the gas is directed at the distal end of the atmospheric-pressure ionization sprayer prior to the atmospheric-pressure ionization sprayer being energized.

31. A method in accordance with claim 30, wherein the atmospheric-pressure ionization sprayer is an electrospray ionization sprayer.

32. A method in accordance with claim 30, wherein the gas directed at the distal end of the atmospheric-pressure ionization sprayer is a nebulizer gas.

33. A method in accordance with claim 30, wherein the rinsing of the transfer line and atmospheric-pressure ionization sprayer takes approximately nine seconds or less.

34. A system for delivering samples for high-throughput mass spectrometric analysis, the system comprising:

a reservoir containing a solvent;

a first pump and a second pump for pumping the solvent from the reservoir, wherein the first and second pumps are coupled to a first valve the first valve being connected to the reservoir, and wherein a delivery flow rate of the first pump is greater than a delivery flow rate of the second pump;

a second valve coupled to the first valve;

an injection system coupled to the second valve, wherein the injection system can deliver a sample to the second valve;

a sample transfer line having two ends, the first end connected to the second valve and the second end connected to an atmospheric-pressure ionization sprayer of the atmospheric-pressure ionization source, wherein the first pump is used to flush the sample transfer line with solvent, and the second pump is used to cause solvent to push samples that have been preloaded from a sample source into the sample transfer line to be delivered through the sample transfer line for analysis.

35. A method for delivering samples for high throughput mass spectrometric analysis, the method comprising:

A. delivering a sample to a transfer line which is coupled to an ionization sprayer of an atmospheric-pressure ionization source;

B. initiating a first flow of a buffer solution to the transfer line contalning the sample, wherein the first flow of the buffer solution causes the sample to be delivered out of the transfer line;

C. energizing the atmospheric-pressure ionization sprayer with a voltage potential and initiating the delivering of a nebulizer gas to the atmospheric-pressure ionization sprayer to generate an ionized plume within the atmospheric-pressure ionization source;

D. conducting mass spectrometric analysis of the ionized sample;

E. de-energizing the atmospheric-pressure ionization sprayer and terminating the delivery of the nebulizer gas to the atmospheric-pressure ionization sprayer;

F. terminating the first flow; and

G. rinsing the transfer line by directing a second flow of the buffer solution to the transfer line, wherein the flow rate of the second flow is greater than the flow rate of the first flow, and wherein the first flow is controlled by a first pump and the second flow is controlled by a second pump.

* * * * *

UNITED STATES PATENT AND TRADEMARK OFFICE

CERTIFICATE OF CORRECTION

PATENT NO. : 7,095,017 B2
APPLICATION NO. : 10/939753
DATED : August 22, 2006
INVENTOR(S) : Steven A. Hofstadler et al.

It is certified that error appears in the above-identified patent and that said Letters Patent is hereby corrected as shown below:

Column 12, line 66: insert --a first valve coupled to the reservoir;-- before "a first"

Column 13, line 64: delete one "the"

Column 15, line 1: delete "30" and insert --24--

Column 15, line 5: delete "the system" and insert --to an atmospheric-pressure ionization source,--

Signed and Sealed this

Twelfth Day of December, 2006

JON W. DUDAS
*Director of the United States Patent and Trademark Office*